US006554512B2

(12) United States Patent
Heno et al.

(10) Patent No.: US 6,554,512 B2
(45) Date of Patent: Apr. 29, 2003

(54) PRINTER FOR PRINTING DEFORMABLE FLAT SUPPORTS AND ITS LOADER

(75) Inventors: Gaëtan Heno, Ancenis (FR); Michaël Hinry, Pouance (FR)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/842,137

(22) Filed: Apr. 26, 2001

(65) Prior Publication Data

US 2002/0159812 A1 Oct. 31, 2002

(51) Int. Cl.[7] ..... B41J 13/12; B65H 3/56; B65H 1/06

(52) U.S. Cl. ..... 400/625; 400/541; 400/624; 400/629; 400/642; 271/10.12; 271/165; 271/167

(58) Field of Search ..... 400/541, 543, 400/521, 624, 625, 629, 633, 642; 271/10.12, 226, 165, 167

(56) References Cited

U.S. PATENT DOCUMENTS 4,619,197 A * 10/1986 Pailler ..... 101/93.04
5,762,431 A * 6/1998 Pawelka et al. ..... 271/225
5,771,058 A * 6/1998 Kobayashi ..... 271/186
6,062,558 A * 5/2000 Takahashi ..... 271/123
6,315,283 B1 * 11/2001 Haas et al. ..... 271/10.09

FOREIGN PATENT DOCUMENTS

JP 57174784 A * 10/1982 ..... G06K/17/00

* cited by examiner

*Primary Examiner*—Daniel J. Colilla
(74) *Attorney, Agent, or Firm*—Young & Thompson

(57) ABSTRACT

A printer comprises a loader (2) for supports (1) to be printed, a printing device (9) and transfer elements delimiting a series of gripping regions (8) forming a transport path (8A) to lead sequentially the printed supports (1) from the outlet (5) of the loader (2) to the printing device (9) and from the printing device (9) toward collection elements disposed below the loader (2). At least the portion of a wall (7) with an opening (4) of the loader (2) is inclined at a positive angle relative to the transport path (8A) to give to the support (1) to be printed an inclination in the inlet direction of a first gripping region (8) of the transport path (8A). The inlet is provided with a deflector (11).

7 Claims, 5 Drawing Sheets

PRINTER FOR PRINTING DEFORMABLE FLAT SUPPORTS AND ITS LOADER

FIELD OF THE INVENTION

The present invention relates to a printer for printing, preferably by thermal transfer, deformable flat supports, such as cards, in particular of plastic material, of the type comprising, from upstream to downstream, a loader for the supports to be printed, adapted to coact with an outlet drive element for the supports from the loader of the type constituted by a cylinder in contact with the supports to be printed by means of an opening provided in a wall of the loader, a printing device and transfer means delimiting a series of zones of grasping forming a transport path to lead sequentially the printed supports from the outlet of the rotor to the printing device and from the printing device toward collection means for the printed supports, said collection means being disposed below the loader, as well as a loader for a printer of the mentioned type.

BACKGROUND OF THE INVENTION

Printers for printing deformable flat supports are well known to those skilled in this art. There can be distinguished two large groups of printers. The first group concerns printers in which the loader and the collection pack are disposed at opposite ends of the frame of the printer.

The second printing group concerns printers in which the collection device and the loader are disposed on a same side of the printer. There results less size of the printer. However, until now, in this type of arrangement, the support to be printed is introduced from the loader into the first gripping region of the transport path of the printer in a horizontal plane parallel to the transport plane. Once the support is printed, this support is removed from the first gripping region by means of transfer means disposed within the printer, then guided to the printer outlet to be transferred to the collection bin. By virtue of its design, size, in particular its height, the printer remains relatively large. Moreover, the fact of deforming the support that has been printed can be prejudicial to the card at the printer outlet. Finally, the guidance at the printer outlet which takes place solely by means of stationary guides, is in a certain number of cases hardly desirable.

SUMMARY OF THE INVENTION

An object of the present invention is to provide a printer of a new type in which the design of the loader and of the transport path of the printer have been modified for, on the one hand, reducing the total size of the printer, on the other hand to improve the guidance of the support to be printed in the course of the phases of entry of the support into the printer and the support leaving this same printer.

To this end, the invention has for its object a printer for the printing, preferably by heat thermal transfer, of deformable flat supports, such as cards, in particular of plastic material, of the type comprising, from upstream to downstream, a loader for the supports to be printed, adapted to coact with a drive element at the outlet for the supports from the loader, of the type constituted by a cylinder in contact with the supports to be printed, through an opening provided in a wall of the loader, a printing device and transfer means delimiting a series of gripping regions forming a transport path to lead sequentially the printed supports from the outlet of the loader to the printing device and from the printing device to the collection means for the printed supports, said collection means being disposed below the loader, characterized in that at least a part of the wall with an opening, of the loader, positioned adjacent the outlet of the loader, is inclined at a positive angle relative to the transport path to give to the support to be printed, at the outlet of the loader, an inclination such that the support and the transport path form, adjacent the inlet of the first gripping region of the transport path, an obtuse angle, the inlet of the first gripping region of the transport path being provided with a deflector oriented on the one hand in the direction of the first gripping region to bring the support which strikes it into a tangential position in the first gripping zone of the transport path, on the other hand toward the collection receptacle to permit evacuation by simple gravity of the printed support into the collection receptacle.

The invention also has for its object a loader for a printer, characterized in that it has at least one inclined wall.

BRIEF DESCRIPTION OF THE DRAWINGS

The invention will be better understood from a reading of the following description of embodiments, with reference to the accompanying drawings, in which.

DETAILED DESCRIPTION OF THE INVENTION

Figure 1:
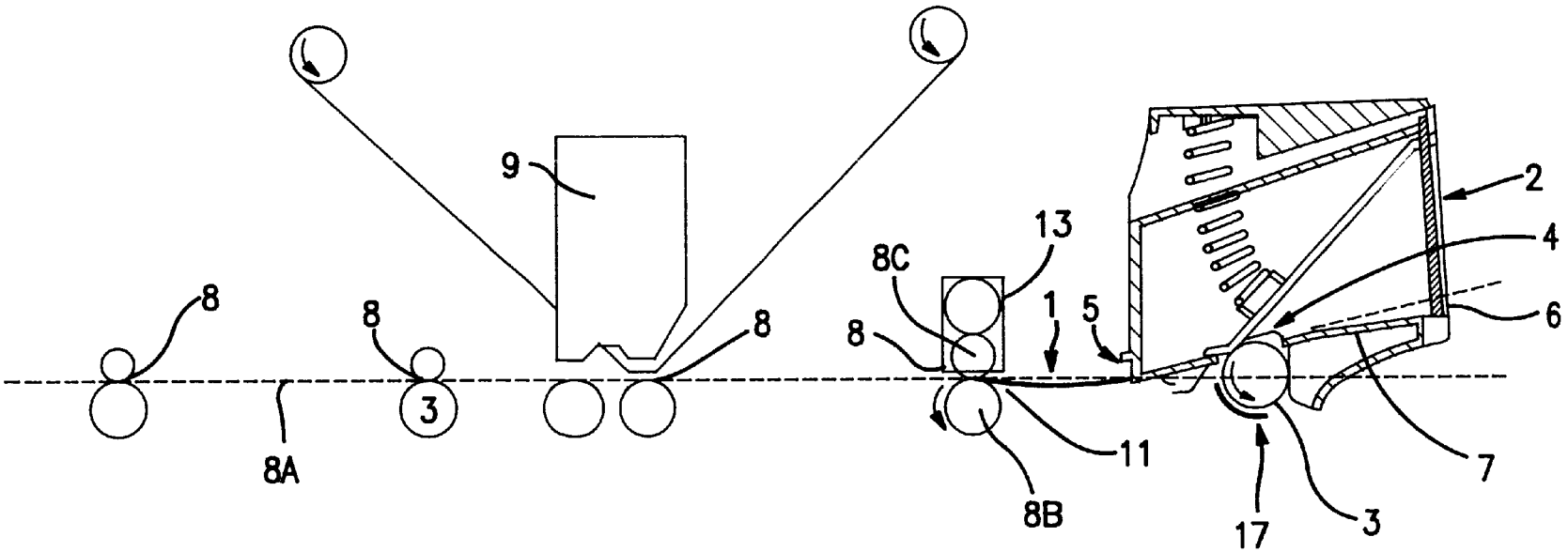
FIG. 1 is a very schematic fragmentary view of a printer according to the invention.

The printer which is the object of the invention, is more particularly adapted for printing, preferably by thermal transfer, deformable flat supports 1, such as cards, in particular of plastic material. This printer comprises, from upstream to downstream, and in a known manner, a loader 2 for the supports 1 to be printed, adapted to coact with a drive element 3 at the outlet of the supports 1 from the loader 2. This drive element 3 is constituted by a cylinder 3 in contact with the supports 1 to be printed through an opening 4 provided in a wall 7 of the loader 2. Of course, this cylinder is driven in rotation by a suitable motor. Downstream of this support, there is provided a printing device 9. Transfer means delimit a series of gripping regions 8 forming a transport path 8A to lead sequentially the printed supports 1 from the outlet 5 of the loader 2 to the printing device 9, then from the printing device 9 towards collection means 10 for the printed supports 1. These collection means 10 are constituted by a bin disposed below the loader 2. Each gripping region 8 is generally constituted by two parallel superposed cylinders applying contact pressure to the support which is to be printed and disposed between said rollers. At least one of the rollers is a power driven roller to permit the movement of the support 1. This plurality of gripping regions 8 is more particularly shown in FIG. 1. The sequence of these gripping regions 8 thus constitutes a path 8A for transport of the support 1.

Figure 3:
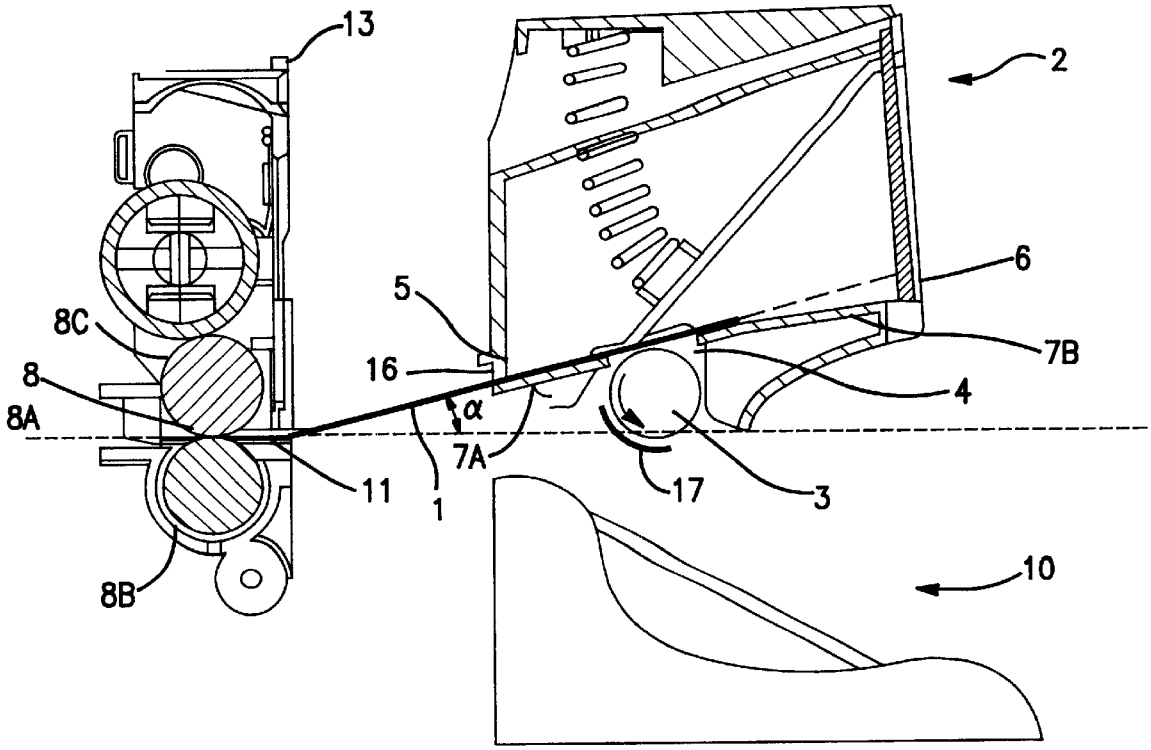
FIG. 3 is a fragmentary schematic view of the loader and of the inlet of the transport path in preliminary position at the entry of the support into said transport path.

As mentioned above, the loader 1 and the collection bin 10 for the supports to be printed are disposed one above the other. In a manner characteristic of the invention, at least the portion of the wall 7 with the opening 4 of the loader 2, positioned adjacent the outlet 5 of the loader 2, is inclined at a positive angle relative to the transport path 8A to give to the support 1 to be printed, at the outlet of the loader 2, an inclination such that the support 1 and transport path 8A form, adjacent the inlet of the first gripping region 8 of the transport path 8A, an obtuse angle. This position is more particularly shown in FIG. 3. The inlet of the first gripping region 8 of the transport path 8A is itself provided with a deflector 11 oriented on the one hand in the direction of the first gripping region 8 to bring the support 1 which strikes it into tangential position in the first gripping region 8 of the transport path 8A, and on the other hand toward the collection receptacle 10 to permit an evacuation by simple gravity of the printed support 1 in the collection receptacle 10. The angle of inclination of the portion 7A of the wall 7 with the opening 4 of the loader 2, positioned adjacent the outlet 5 of the loader 2, is particularly important. If the angle of inclination is too great, there is a risk of giving rise to wedging of the support 1 at the outlet of the loader during its coaction with the deflector 11. Thus, it will be seen particularly during movement of the support between the positions of FIGS. 3 and 4, that this support 1 tends, after having struck the deflector 11, to take on a curvature to be introduced into the transport path 8, if the radius of curvature of the support 1 is too great, because of too high an inclination of the portion 7A of the wall 7 with the opening, of the loader 2, there results risk of wedging of the support 1 and an impossibility of moving it in a suitable manner. Conversely, if the inclination of this slope is insufficient, it becomes more difficult, in terms of size, to dispose the cylinder 3 constituting the drive element for the discharge of the supports 1 from the loader 2 between the transport path and the bottom wall of the loader 2, as shown in FIG. 3.

For reasons mentioned above, the portion 7A of the wall 7 with the opening 4, of the loader 2, positioned adjacent the outlet 5 of the loader 2, forms with the plane passing through the gripping regions 8, an angle $\alpha$ comprised in the range of 12–20°, preferably around 15°.

Figure 4:
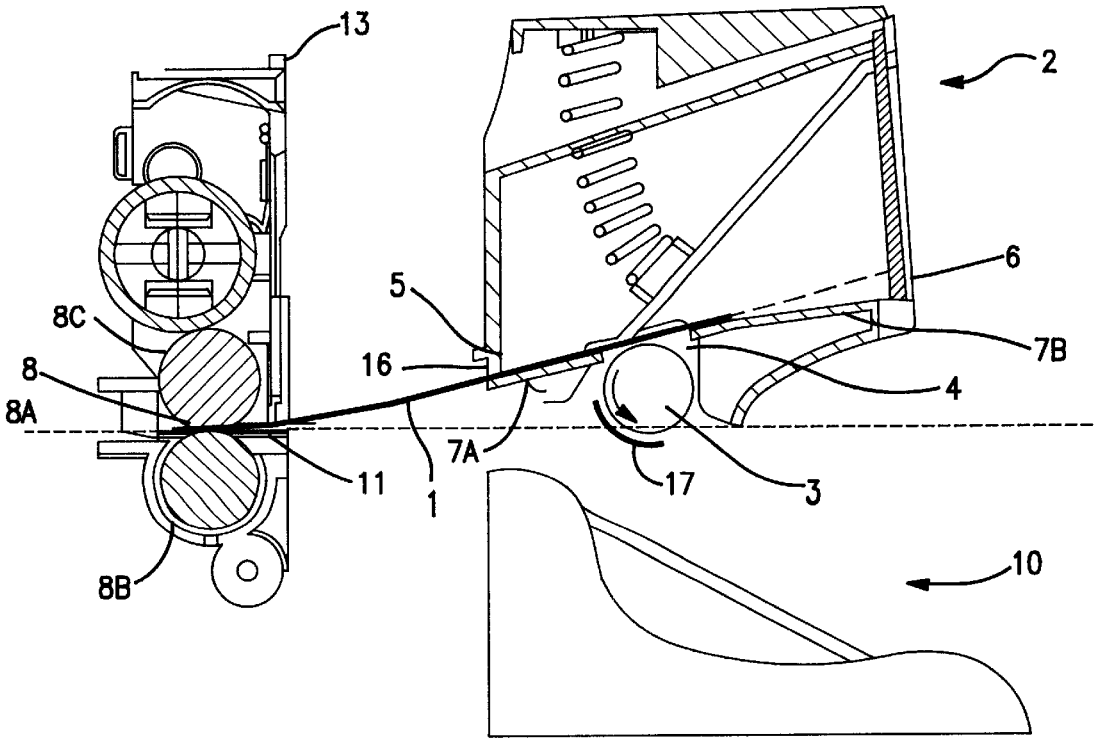
FIG. 4 is a fragmentary schematic view according to FIG. 3 in the position of introduction of the support within the transport path.
Figure 5:
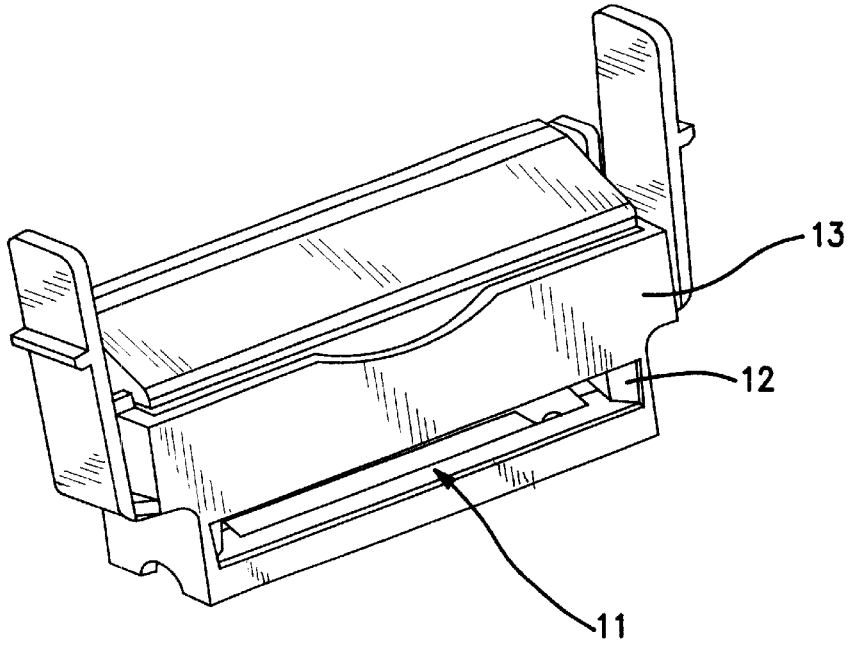
FIG. 5 is a perspective view of a cleaning cartridge incorporating a deflector according to the invention.

Moreover, the portion 7A of the wall 7 with the opening 4, of the loader 2, positioned adjacent the outlet 5 of the loader 2, is prolonged in the direction of the inlet 6 for introduction of the supports 1 into the loader 2 by a portion 7B of the wall 7 of a slope less than said first wall. This modification of the slopes permits delimiting, at the level of the portion 7B of wall 7, with the supports 1 disposed in the loader 2, a hopper permitting the manual introduction into the loader 2 of a support 1 to be printed that has to be treated with priority. Thus, as shown in FIG. 3, the hopper, delimited by the coaction of the support 1 and the wall portion 7B, has been shown partly in broken line. It is possible to introduce manually into this hopper a fresh support to be printed and to bring it directly into contact with the cylinder 3 which will handle with priority the new support. The deflector 11 is itself constituted by a ramp disposed immediately upstream of the first gripping region 8. This ramp arises in or slightly below the plane passing through the gripping regions 8 and is inclined in the direction of the collection means 10. As shown in FIGS. 3 and 4, this deflector 11 constituted by an inclined ramp, is laterally bounded by inlet bevels 12 that converge in the direction of the first gripping region 8A, as shown in FIG. 5. These inlet bevels ensure a centering of the support 1 before its entry into the first gripping region 8. This deflector 11 and if desired the bevels 12, positioned upstream of the first gripping region 8, can be coupled directly to the frame of the printer and can form in this case a stationary deflector.

Conversely, in the example shown in the drawings, the first gripping region 8 is constituted by superposed parallel rollers 8A, 8C delimiting between them said gripping region of the support 1. The upper roller 8C, constituting a cleaning roller, presses the support 1 against the rotatable transport roller 8B to clean the support 1 parallel to its movement along the transport path 8A. This cleaning roller 8C is disposed within a cartridge 13 formed of a single piece with the deflector 11. Said cartridge 13 is removably mounted on the printer. This cartridge 13, which has the form of a box adapted to receive at least one cleaning roller 8C, even if desired two superposed cleaning rollers as shown in the drawings, comprises, in its front wall, a slot extending substantially parallel to the transport path, the lower edge of this slot constituting the deflector 11. The detailed design of this cartridge 13 will not be described in detail because it does not directly constitute the object of the invention. The interest of positioning a deflector 11 on a cartridge 13 removably mounted on the printer, this cartridge constituting a throwaway, being adapted to be regularly changed, is an absence of wear on the deflector 11. Moreover, the presence of the deflector 11 and its positioning in particular permits avoiding any damage of the cleaning roller or respectively the transport roller during introduction of the card into the transport path.

Figure 2A:
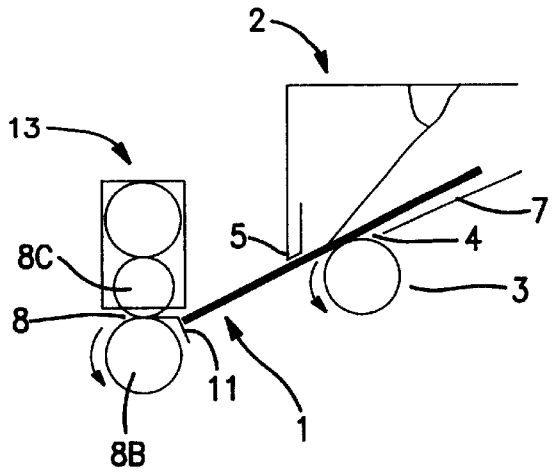
FIGS. 2A to 2C are fragmentary schematic views of the path of the support 1 respectively between the outlet of the loader and the inlet of the transport path and the outlet of the loader and deposition within the collection means.
Figure 2B:
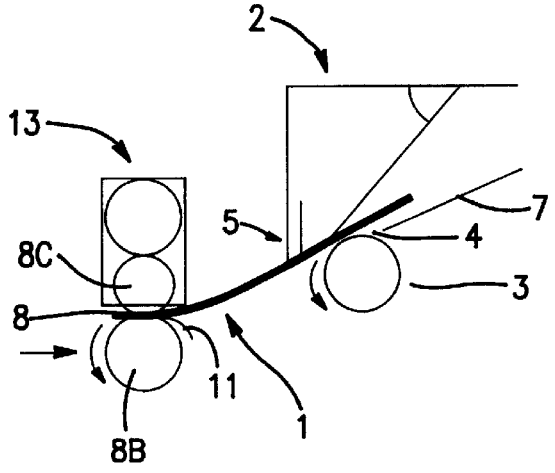
Figure 2C:
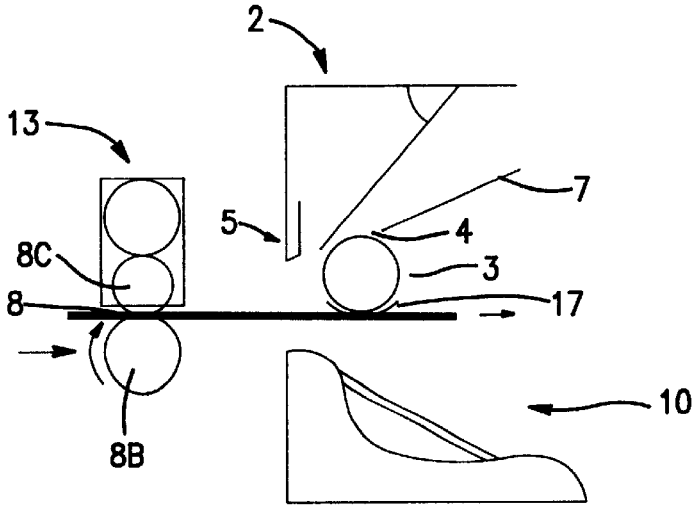
Figure 6:
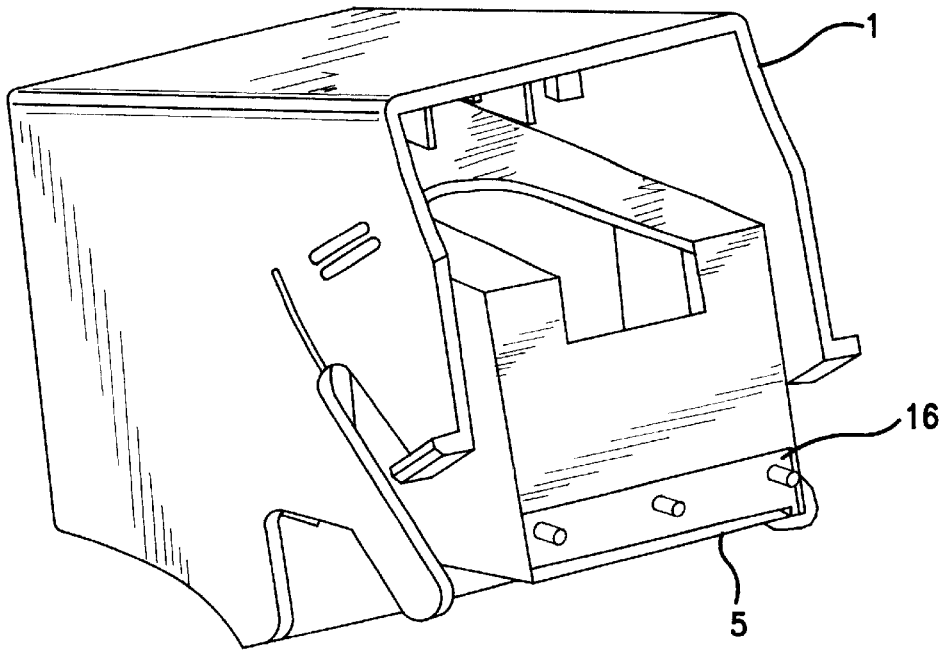
FIG. 6 is a rear perspective view of a loader according to the invention.

The outlet 5 of the loader 2 has itself the form of a slot as shown in FIG. 6. This slot is closed at least partially by means of a strip 16 formed by a flexible blade. This strip 16 prevents the simultaneous exit of several supports 1 to be printed. Thanks to such a coaction of the active wall of the loader 2 and of the deflector 11, the support 1 comes in a first instance to strike the deflector, then deforms by curving as shown in FIG. 2B so as to become positioned tangentially to the gripping region 8. The support 1 is then driven along the transport path by simultaneous action of the drive cylinder 3 of the loader 2 and of the transport roller 8B coacting in the production of the first gripping region. Thus, although deformed, the card subjected to the action of the two motor elements, is easily driven within the transport path. The movement of this card is carried out until the printing device, shown in FIG. 1. This printing device will not be described in detail because it is well known to those skilled in this art. The support 1 is then brought in the direction of the first gripping region to be extracted from the printer. This extraction operation takes place according to the schematic view shown in FIG. 2C. Because of the inclination of the wall 7 of the bottom of the loader, of the positioning of the driven roller 3 acting on this loader 2 and the design of the deflector, the removal of the support 1 from the printer can take place freely and simply by the action of the transport roller 8B coacting with the construction of the first gripping region 8.

However, to avoid any damage of the drive roller 3 of the loader 2, there can be provided a deflector 17 positioned between the drive roller 3 and the plane passing through the transport path. This deflector permits avoiding any damage of the cylinder 3 of the loader 2. It is to be noted that the collection means 10 are constituted by a bin 10 whose bottom is constituted by an inclined wall, the orientation of this inclination being identical to that of the deflector 11. This inclination against facilitates the positioning of the support 1 in abutment against the upstream end of the receptacle 10.

Thanks to the design of such a printer, it is not necessary to increase the number of drive elements serving for the guidance of the support 1 at the inlet and the outlet of the printer. The stationary members, such as deflectors, permit a perfect guidance of the support 1.

What is claimed is:

1. A printer for printing deformable flat supports, which comprises, from upstream to downstream, a loader for the supports to be printed; said loader having an outlet and adapted to coact with a drive element at the outlet of the support from the loader; said drive element comprising a cylinder in contact with the supports to be printed through an opening provided in a wall of the loader;

a printing device for printing the supports;

a collection means disposed below the loader for collecting printed supports;

transfer means delimiting a sequence of gripping regions forming a transport path which leads the supports sequentially from the outlet of the loader to the printing device, and from the printing device to the collection means;

at least a portion of the wall positioned adjacent the outlet of the loader being inclined at a positive angle relative to the transport path to give to a support to be printed, at the outlet, an inclination such that the support and the transport path form, adjacent an inlet of a first gripping region of the transport path, an obtuse angle;

a deflector oriented in the direction of the first gripping region to bring the support which strikes said deflector into tangential position in the first gripping region of the transport path;

said deflector comprising a ramp disposed immediately upstream of the first gripping region; said ramp arising in or slightly below the plane passing through the gripping regions and being inclined in the direction of the collection means to permit evacuation by simple gravity of the printed support into the collection means.

2. The printer according to claim 1, wherein the portion of the wall with the opening of the loader, positioned adjacent the outlet of the loader, forms with the plane passing through the gripping regions an angle $\alpha$ comprised within the range of 12 to 20°.

3. The printer according to claim 2, wherein the angle is about 15°.

4. The printer according to claim 1, wherein the portion of the wall with the opening of the loader, positioned adjacent the outlet of the loader, is prolonged in the direction of an introduction inlet for introducing the supports into the loader by an other portion of the wall of a lower slope delimiting with the supports disposed in the loader, a hopper permitting the manual introduction into the loader of a support to be printed.

5. The printer according to claim 1, wherein the inclined ramp, is bordered laterally by inlet bevels that converge in the direction of the first gripping region; said inlet bevels ensuring a centering of the support before its entry into the first gripping region.

6. The printer according to claim 1, wherein the first gripping region is constituted by parallel superposed rollers comprising an upper roller constituting a cleaning roller, pressing the support against a lower rotating transport roller for cleaning the support parallel to its movement along the transport path; said cleaning roller being disposed within a cartridge formed of a single piece with the deflector, said cartridge being mounted removably on the printer.

7. The printer according to claim 1, wherein the outlet of the loader has a shape of a slot at least partially closed by a strip formed by a flexible blade; said strip preventing the simultaneous emission of several supports to be printed.

* * * * *